US005209043A

United States Patent [19]

Kupcikevicius

[11] Patent Number: 5,209,043

[45] Date of Patent: May 11, 1993

[54] VACUUM PACKAGING METHOD AND APPARATUS

[75] Inventor: Vytautas Kupcikevicius, Oaklawn, Ill.

[73] Assignee: Viskase Corporation, Chicago, Ill.

[21] Appl. No.: 845,307

[22] Filed: Mar. 3, 1992

[51] Int. Cl.[5] ..... B65B 31/02; B65B 7/06

[52] U.S. Cl. ..... 53/434; 53/373.7; 53/374.8; 53/391; 53/512; 53/479

[58] Field of Search ..... 53/434, 432, 512, 510, 53/391, 390, 479, 477, 373.7, 374.9, 374.8

[56] References Cited

U.S. PATENT DOCUMENTS

| | | | |
|---|---|---|---|
| 3,886,713 | 6/1975 | Mitchell et al. | 53/479 X |
| 3,958,391 | 5/1976 | Kujubu | 53/434 |
| 4,132,048 | 1/1979 | Day | 53/434 |
| 4,478,025 | 10/1984 | Scanlam | 53/512 |
| 4,640,081 | 2/1987 | Kawaguchi et al. | 53/510 |
| 4,754,596 | 7/1988 | Yasumune et al. | 53/479 X |
| 4,779,398 | 10/1988 | Glandon et al. | 53/434 |
| 4,903,459 | 2/1990 | Okinaka | 53/479 X |
| 5,062,252 | 11/1991 | Kupcikevicius | 53/434 |

FOREIGN PATENT DOCUMENTS 33915 2/1986 Japan .

*Primary Examiner*—James F. Coan
*Attorney, Agent, or Firm*—Roger Aceto

[57] ABSTRACT

Vacuum packaging apparatus and method for evacuating and heat sealing bags employs a clamp, swingable over substantially the full length of the bagged product, to effect a temporary air-tight seal of an evacuated bag during transport of the evacuated bag from an evacuating zone to a heat sealing zone. The apparatus also includes a platen having a shallow V-shaped configuration to cradle the bagged product and the V-shaped being flattened to a plane and the platen being elevated to facilitate automatic removal of the bagged product from the platen.

29 Claims, 5 Drawing Sheets

VACUUM PACKAGING METHOD AND APPARATUS

TECHNICAL FIELD

The present invention relates generally to a method and an apparatus for vacuum packaging food items in heat sealable plastic bags.

BACKGROUND OF THE INVENTION

Vacuum packaging in heat sealable plastic bags is a conventional way of packaging food items such as whole fowl, cuts of meat, cheese bricks and the like for sale at retail. Vacuum packaging involves placing the food item in a heat sealable plastic bag and then communicating the bag to a partial vacuum to evacuate air from the bag and collapse it about the food item. The bag is heat sealed in its evacuated condition so the food item becomes encased in a generally air-free environment.

It also is customary to fabricate the bag from a heat shrinkable plastic film. After sealing, the bagged food item is immersed in hot water or otherwise exposed to heat to shrink the bag so it is tight about the food item. This makes the bag substantially wrinkle-free and enhances the appearance of the bagged article for retail sale.

Apparatus, as disclosed for example in U.S. Pat. No. 5,062,252, has been developed to automate the vacuum packaging operation. The apparatus as disclosed in this patent has a plurality of carriers arranged for movement along a closed path of travel. During the course of moving through its closed path of travel, an open bag containing the article to be packaged is placed on the carrier. Each carrier then merges with a vacuum chamber and a partial vacuum is created to evacuate the bag. Each carrier is provided with a mechanically operated clamp that relies on an over-center force exerted by coil springs to hold the clamp at either a full open or a full closed position. The clamp closes against the bag neck after evacuation to maintain the bag in an evacuated state when the vacuum chamber separates from the carrier. The path of travel followed by each carrier carries it to a heat sealing zone containing at least one heat sealer which operates to heat seal each bag. After heat sealing, the clamp is opened and the carrier is moved to a location where the bagged article is removed.

The vacuum packaging apparatus of the present invention employs the concept as disclosed in U.S. Pat. No. 5,062,252 of clamping the evacuated bag so heat sealing the evacuated bag can occur outside the vacuum chamber. However, the clamping arrangement is modified to permit the clamp structure to swing over the bagged product to a clamped position and eliminates the need for springs to hold the clamp at a full open or a full closed position. The present invention also provides a platen on the carrier for supporting the bagged product and has a means for elevating and lowering the platen to facilitate automatic removal of the article from the carrier after vacuum packaging.

SUMMARY OF THE INVENTION

The present invention may be characterized in one aspect thereof by a vacuum packaging apparatus having carriers moveable in a closed path through successive loading, evacuation, heat sealing and unloading zones, each carrier comprising:

a) a platen for receiving an open bag containing an article to be packaged, said platen having opposite first and second ends;

b) an upstanding anvil adjacent said platen first end for receiving an open neck portion of said bag draped across said anvil;

c) a clamp having end portions journaled at either side of said platen such that said clamp spans said platen and is pivotable over said platen from and between a full open position wherein said clamp is disposed adjacent said platen second end and a full closed position wherein said clamp is disposed against said anvil;

d) drive means operable in an interval between said loading and evacuating zone for swinging said clamp from said full open position and towards said full closed position; and e) latch means operable in said evacuation zone for engaging and drawing said clamp tightly against said anvil to effect a mechanical air tight seal of the bag neck draped across said anvil.

The present invention is further characterized in another aspect thereof by a vacuum packaging method comprising the steps of a) moving a carrier through successive loading, evacuating, heat sealing and unloading zones;

b) placing an open article-containing bag having a pre-closed end onto said carrier at said loading zone and arranging the open end of the bag to a flat width;

c) during transit between said loading and evacuating zones, swinging a clamp member, which spans the article-containing bag over substantially the full length of the bag from a full open position adjacent the pre-closed end of the bag towards a position adjacent to but spaced from the open end of the bag;

d) evacuating air from the article-containing bag in the evacuation zone and thereafter drawing said clamp member down to a position tightly clamped against the open bag end for effecting an air tight mechanical seal of the bag;

e) moving said carrier to said heat sealing zone and in transit exposing said article-containing bag to atmospheric pressure while maintaining said air tight mechanical seal;

f) heat sealing across the flat width of said bag to effect a permanent air tight seal thereof and then moving said carrier to said unloading zone;

g) releasing said clamp member and swinging it back over the length of the article-containing bag to the clamp full open position; and h) removing the now sealed article-containing bag from the carrier at the unloading zone.

DETAILED DESCRIPTION OF THE INVENTION

Figure 1:
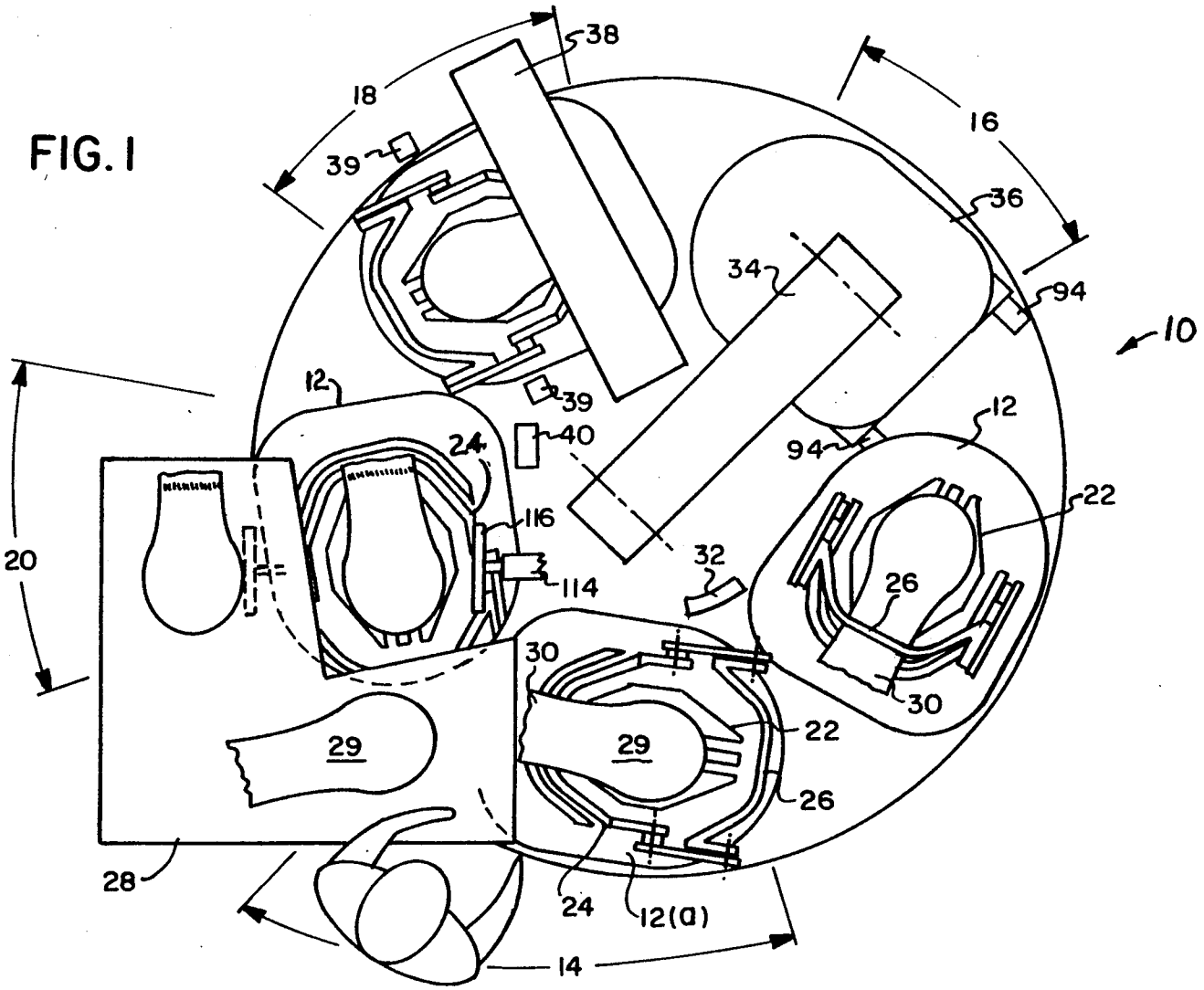
FIG. 1 is a schematic plan view of a vacuum packaging apparatus in accordance with an embodiment of the present invention.

Referring to the drawings, FIG. 1 shows a vacuum packaging apparatus of the invention to comprise a carousel arrangement generally indicated at 10. The carousel includes a plurality of carriers 12 which are moved in a step wise fashion through successive zones including a loading zone 14, evacuating zone 16, sealing zone 18, and unloading zone 20. Each carrier unit includes a platen 22 for supporting a bagged product. An anvil 24, upstands from each carrier adjacent one end of the platen and extends generally transverse the carrier path of travel. Each carrier also has a clamp 26. In a full open position, clamp 26 lies at an opposite end of the platen 22 from anvil 24. In a full closed position the clamp is pressed against the anvil so in moving from its full open to its full closed position, the clamp swings over platen 22.

The carousel moves each carrier in a counterclockwise direction as viewed in FIG. 1. In the course of such movement, the carriers pass beneath a platform 28 which occupies at least a portion of the loading and unloading zones. For loading purposes, the platen is below the level of platform 28 but for unloading, the platen 22 is movable vertically with respect to the carrier 12 up to the level of platform 28.

Briefly, an operator standing at the loading zone will move a bagged article 29 from platform 28 and drop it onto the platen 22 of a first carrier 12*a* as the carrier emerges from beneath table 28. The operator moves the bagged product so it butts up against the anvil 24 and arranges the open neck 30 of the bag to a flat width and drapes it across anvil 24. The carousel then indexes the first carrier towards the evacuation zone 16. During passage from the loading zone to the evacuation zone the carrier traverses a cam 32 which causes the clamp 26 to swing over the platen to a partly closed position where the clamp lies across the bag neck 30 but is not pressed against the anvil 24 so the neck of the bag remains open.

At the evacuation zone there is a vacuum chamber 36. The vacuum chamber is carried at the end of an arm 34 which incorporates a parallel motion linkage (not shown) for raising and lowering the chamber. Thus, when the carrier is at the evacuation zone, the arm 34 lowers the vacuum chamber over the platen and against the carrier. After the chamber closes against the carrier, the chamber is evacuated through vacuum lines (not shown) to exhaust air from the chamber and the bag. After evacuation, the clamp on the carrier within the chamber is closed tightly against the anvil and locked in position thereby effecting an air tight closure of the bag neck.

The vacuum chamber is vented and then it opens and the carrier is stepped to the sealing zone 18. At the sealing zone there is a bridge structure 38 which carries a heat sealer (not shown). When the carrier is located beneath the bridge, the sealer is closed against a portion of the bag neck which extends out from under the clamp 26 to effect a permanent air tight heat seal closure of the bag. The heat sealer opens i.e., lifts from the bag neck and up into the bridge structure so the carrier can be stepped to the unloading zone 20. In transit to the unloading zone the carrier first traverses cams 39 which unlock the clamp and then it traverses a cam 40 which swings clamp 26 to an open position. At the unloading zone the carrier unit stops, the platen 22 is elevated and a pusher 114, 116 is operated to remove the sealed bag from the carrier unit and onto platform 28. The platen then is lowered so that in the next step-wise indexing of the carrier, it can pass beneath the platform as the carrier moves back to the loading zone 14 where the entire operation repeats.

Figure 2:
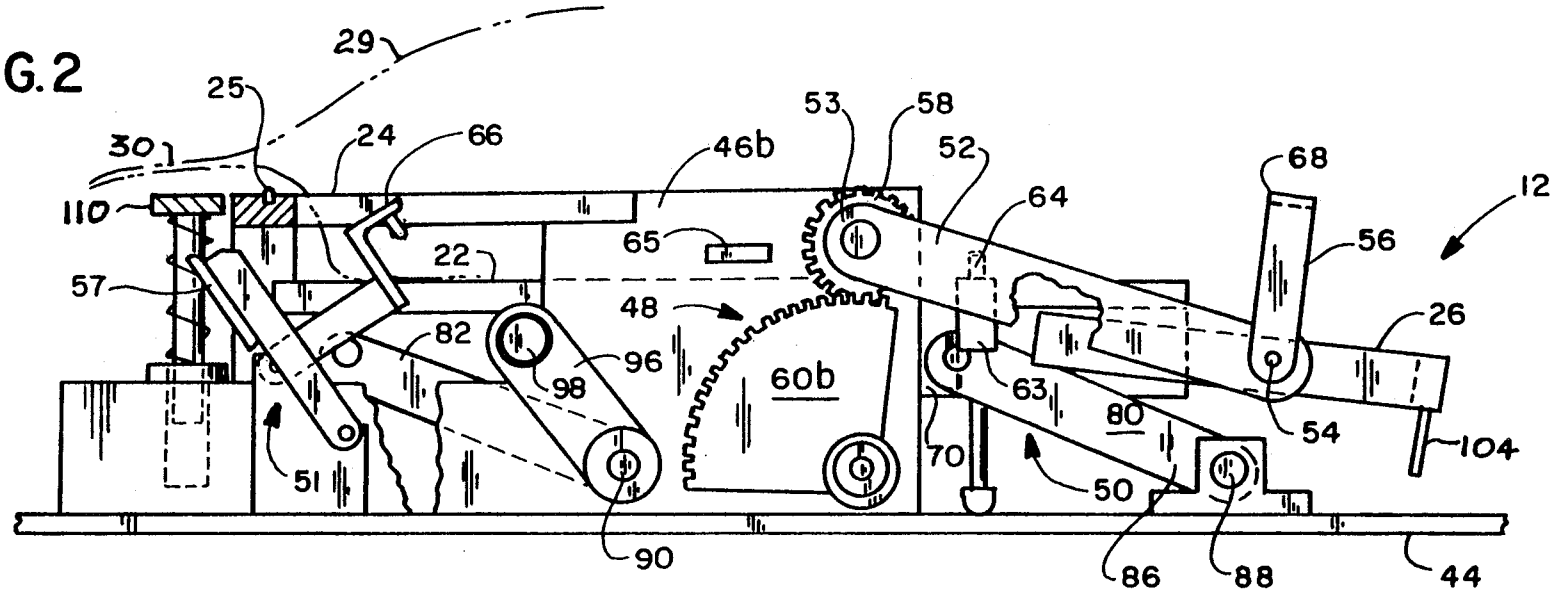
FIG. 2 is a side elevation view partly broken away and in section showing selected components of the apparatus of the present invention in a bag receiving position.
Figure 4:
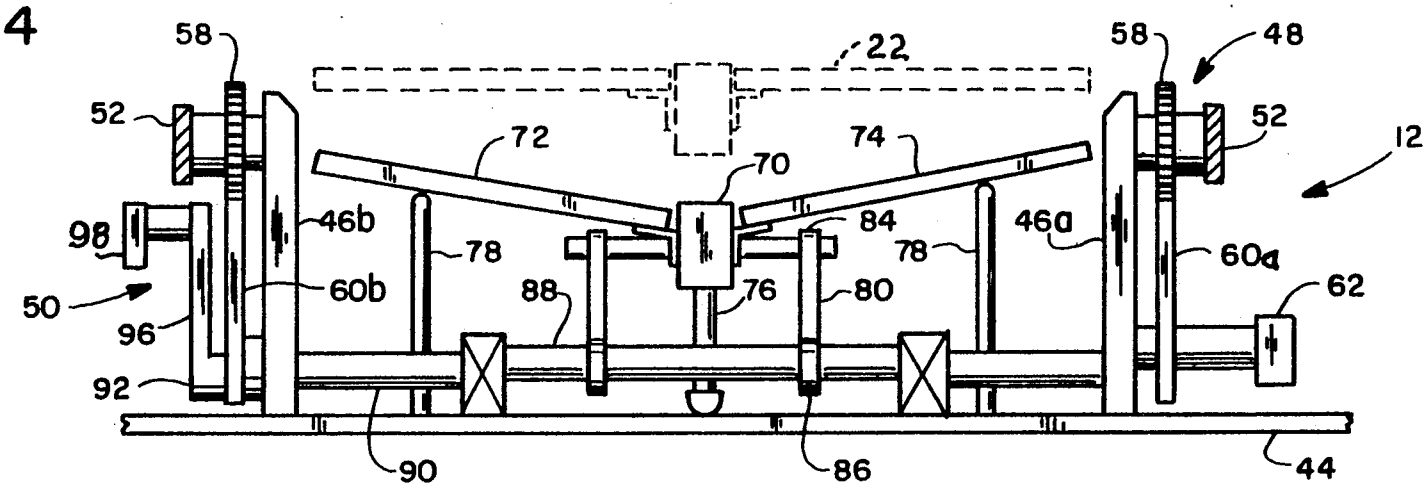
FIGS. 3 and 4 are plan and end views respectively of FIG. 2 with portions removed for clarity.
Figure 3:
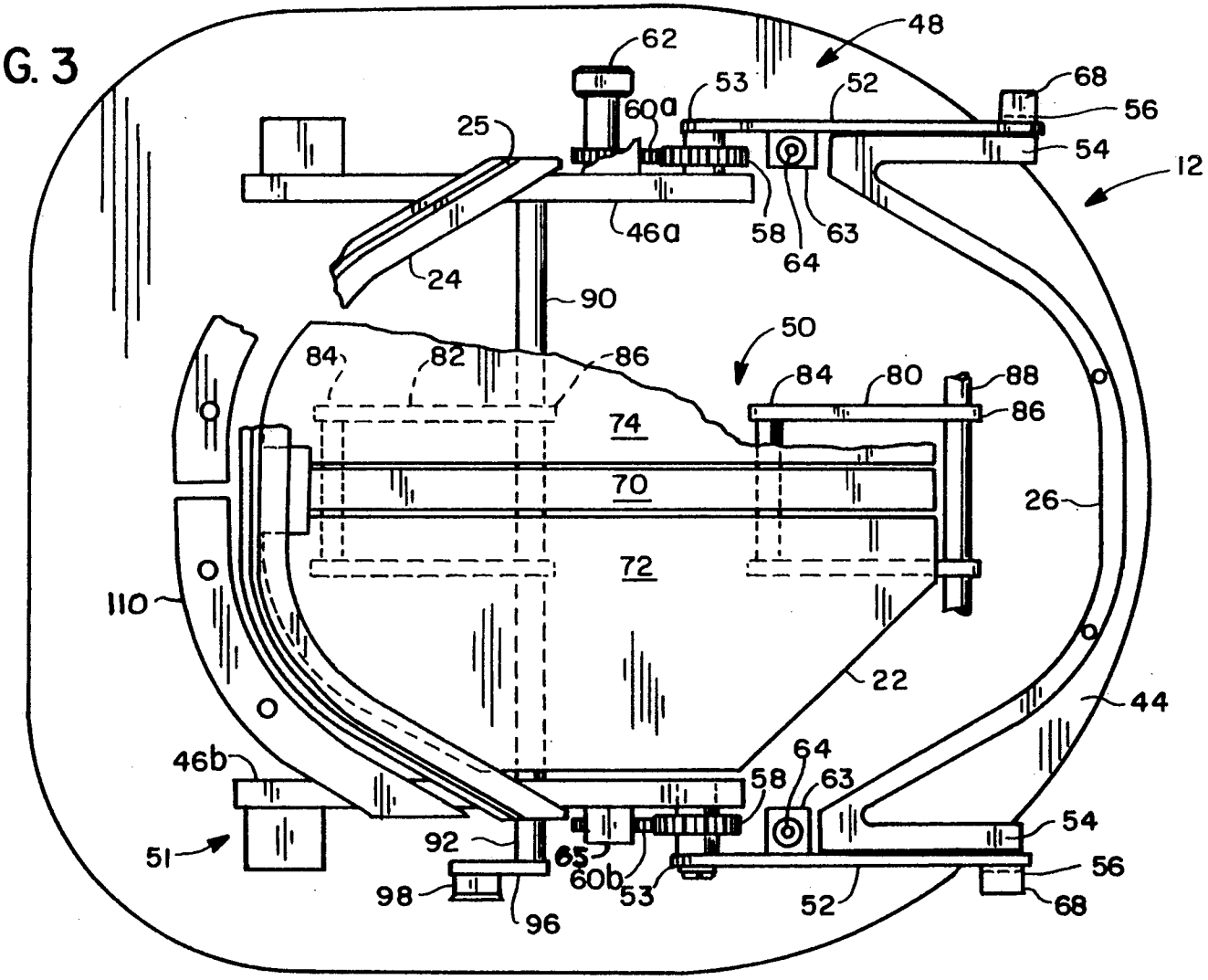

Referring now to FIGS. 2–4, each carrier 12 has a base 44 connected to the carousel mechanism for transporting the carrier through the successive zones as noted above. Each carrier 12, except for a few components, is symmetrical on either side of a longitudinal axis. To orient the location of these few components, as described hereinbelow, the end of the carrier having anvil 24 will be considered as the end which trails in the direction of rotation. Thus, the longitudinal axis of the carrier extends generally parallel to the path of travel and the side of the carrier towards the center of the carousel is identified as the "inboard" side of the carrier whereas the side towards the outer periphery of the carousel is the "outboard" side.

With this reference, FIGS. 2–4 show the base to include upstanding inboard and outboard 46*a*, 46*b* respectively which are spaced apart and arranged generally parallel to the carrier longitudinal axis. Platen 22, (as best seen in FIGS. 3 and 4), is disposed in the space between these walls. Anvil 24 (FIGS. 2 and 3) extends across the walls 46*a,b* and is supported generally elevation of the top of the walls. Further, in the embodiment shown, anvil 24 is generally U-shaped and is provided with a seat to receive an O-ring 25 or other suitable resilient seal member (FIG. 3).

Either connected to, or extending between, these side walls are several assemblies which will be described separately hereinbelow. These assemblies include a clamp and clamp drive assembly generally indicated at 48, a platen elevating assembly generally indicated at 50 and a latch mechanism 51 for holding the clamp in a locked position.

The embodiment of the invention as shown in the figures is designed for the packaging of poultry such as fresh or frozen turkey and the like, wherein a heat seal for closing the bag is made around the breast portion of the bird. Accordingly the clamp structure and heat sealer as shown in the drawings and as described further hereinbelow are designed and arranged to effect a generally U-shaped seal which follows the contour of the breast portion of the bird. With this in mind, FIGS. 2 and 3 show clamp and drive assembly 48 to include a pair of arms 52 each journaled at one end 53 to walls 46*a,b*.

Attached to the opposite end of each arm at 54 and extending between the arms 52 is clamp 26. The clamp is a generally U-shape member (FIG. 3) so it spans the space between walls 46*a,b* wherein the arms 52 can be considered end portions of the clamp which are attached to the walls 40*a,b*. The connection at 54 between arms 52 and U-shaped clamp 26 allows for some limited tilting of the clamp about the arm. This permits the clamp to self adjust when seating against anvil 24.

Figure 6:
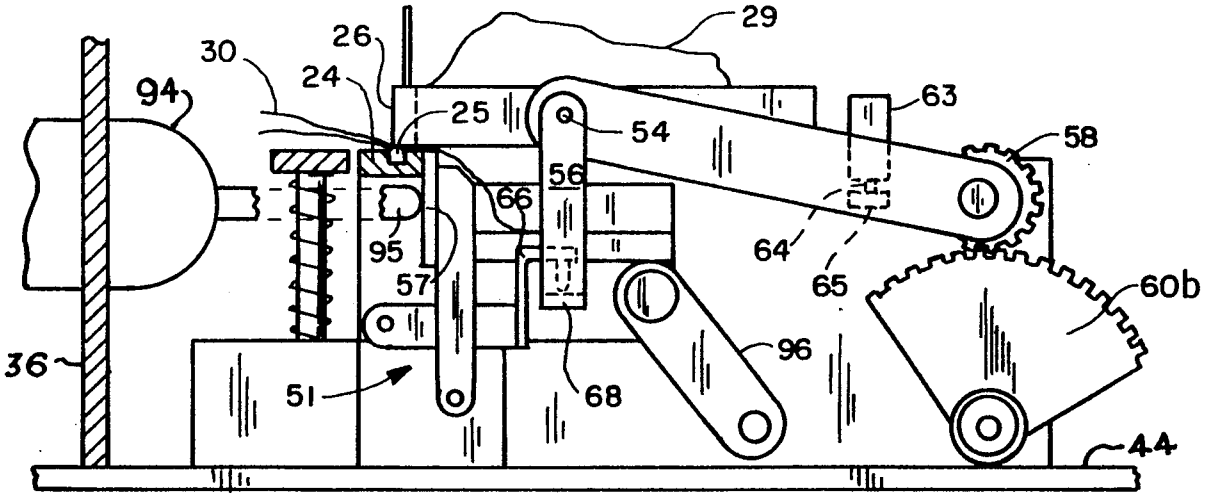
FIGS. 6 and 7 are views of a portion of FIG. 2 only showing the position of components in a bag clamping position and a bag sealing position respectively.

The general U-shape of clamp 26 and the disposition of arms 52 allow the clamp to swing from the position shown in FIG. 2, up and over the bagged product 29 towards a clamping position against the O-ring 25 on the anvil (FIG. 6). Thus the clamp 26 swings in an arc which extends above and over substantially the entire length of a bagged product 29 resting on platen 22 (FIG. 1).

Extending from each connection 54 between clamp 26 and each arm 52 is a latch member 56 (FIGS. 2, 3, 5 and 6). Each latch member is fixed with respect to arm 52 and cooperates with latch mechanism 51 to hold the clamp in a bag clamping position as further described hereinbelow.

A pinion 58 is fixed to each arm 52 where the arm is journaled to the walls 46*a,b*. Each pinion 58 is engaged by a quarter section of a spur gear 60*a,b*. One spur gear 60 is journaled to each wall 46*a,b* and each gear is arranged for movement through an arc of approximately 90°. However extending from only the spur gear 60*a* journaled to the inboard wall 46*a* is a cam follower 62 (FIGS. 3 and 4). The cam follower 62 is engaged to rotate the spur gear which then rotates the pinion 58 to swing arms 52 clockwise or counterclockwise.

Figure 5:
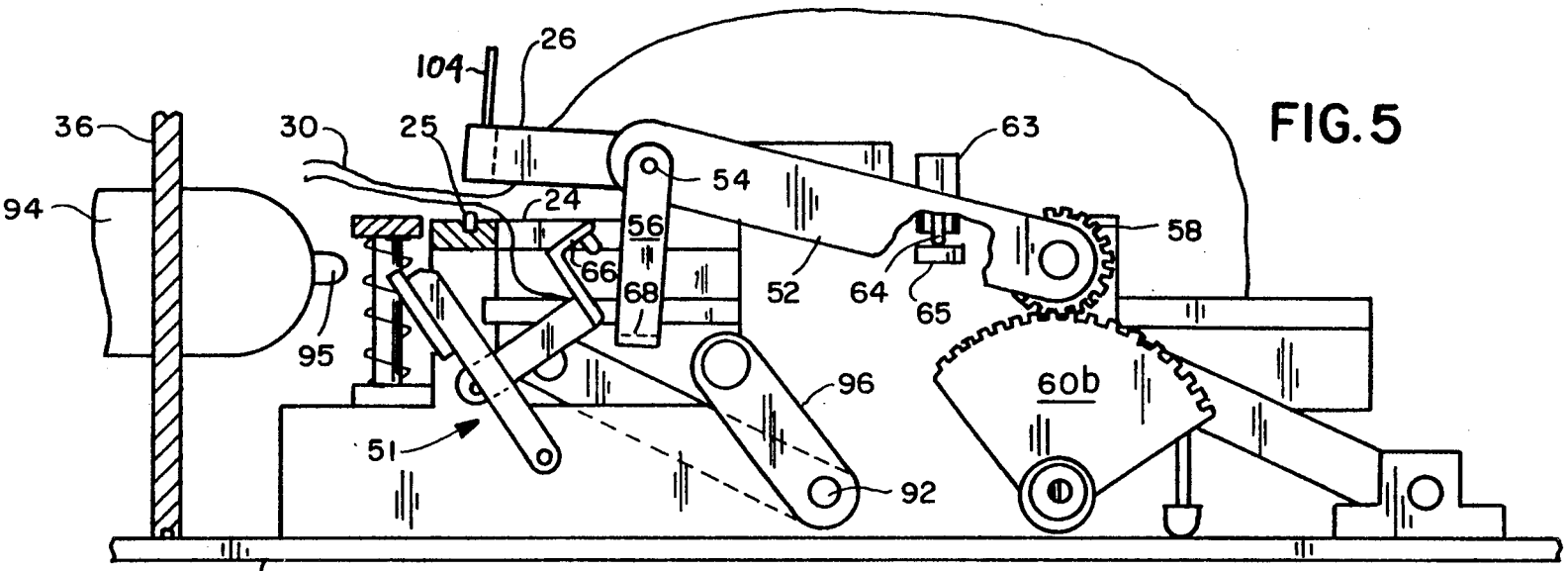
FIGS. 5 is a view similar to FIG. 2 only showing selected components in a bag evacuating position.

Swinging arms 52 counterclockwise will carry clamp 26 over bagged article 29 and towards anvil 24. However, each arm 52 carries a housing 63 which contains a spring biased plunger 64. As best seen in FIG. 5, the spring biased plungers 64 on the clamp arms 52 are arranged to contact a stop 65 on each wall 46*a,b* just before the clamp 26 contacts the anvil 24. The engagement of the plunger 64 against stop 65 serves to prevent the clamp from resting against the O-ring seal member 25 for purposes further described hereinbelow.

In order to latch the clamp 26 tightly against O-ring 25, carrier 12 is provided with a latch mechanism 51 attached to both the inboard and outboard walls 46*a,b* respectively adjacent anvil 24 (FIG. 2 and FIGS. 5–7). Each latch mechanism 51 is a conventional over center lock, as sold for example by Dower Corporation, which is modified slightly to facilitate its operation as described hereinbelow. In its open position, each latch mechanism 51, as shown in FIGS. 2 and 5, is pivoted to a counter clock wise position. This allows the latch members 56 which extend from clamp arm 52 to pass by the latch mechanisms 51 as the clamp arm is pivoted counterclockwise. Thereafter, when each latch mechanism is activated, as describe hereinbelow, it pivots clockwise to the position shown in FIG. 6. Pivoting the latch 51 clockwise carries a cantilevered finger 66 on the mechanism down and against a shoulder 68 on latch member 56. This engagement pulls the clamp 26 down tightly against the O-ring 25 on anvil 24. Also, it should be noted that the connections (at 54) of each latch member 56 to clamp 26 lie on an axis which extends through the centroid of the clamp. Accordingly, when the clamp is pulled tightly against the anvil and O-ring seal member 25 by a force applied at this connection, the force is uniformly distributed over the entire anvil-clamp contact surface.

As the finger 66 engages and pulls down on shoulder 68, the latch member 56, arm 52 and clamp 26 also are pulled downwardly against the bias of plunger 64. The plunger, being seated against stop 65, recedes into its housing 63 as the clamp 26 is locked tightly against O-ring 25 (FIG. 6). In this fashion there is provided a mechanical air tight seal of the portion of the bag neck 30 draped across the anvil.

As described hereinabove, platen 22 is disposed in the space between walls 46*a,b* so its opposite ends are oriented transverse the carrier path of travel. As shown in FIGS. 3 and 4, platen 22 includes two platen sections 72, 74 hinged to a spine 70 extending generally along the mid-line of carrier 12.

The hinge connection allows the sections 72, 74 to define an included angle between them so as to form a V-shaped cradle when the platen 22 is at its lowermost position (see FIG. 4). In this respect spine 70 has a depending foot 76 which is adjustable in height to change the lowermost elevation of the spine. The platen sections 72, 74 hinged to the spine each rest on pillars 78 that upstand from base 44. The pillars also are height adjustable. The V-shape assumed by platen sections 72, 74 effectively cradles a bagged product to center it on the platen and prevent side-to-side motion. Also by adjusting the height of foot 76 and pillars 78 the height of the sections 72, 74 can be adjusted to accommodate different sizes of bagged articles and to change the location of the horizontal seal made across the neck of the bag. For example, if the bagged article is large and bulky, the platen sections are set to a lower elevation to make an on-center seal. If the bagged article is smaller and less bulky, the platen sections are set to a higher elevation for making an on-center seal.

Figures 7, 8:
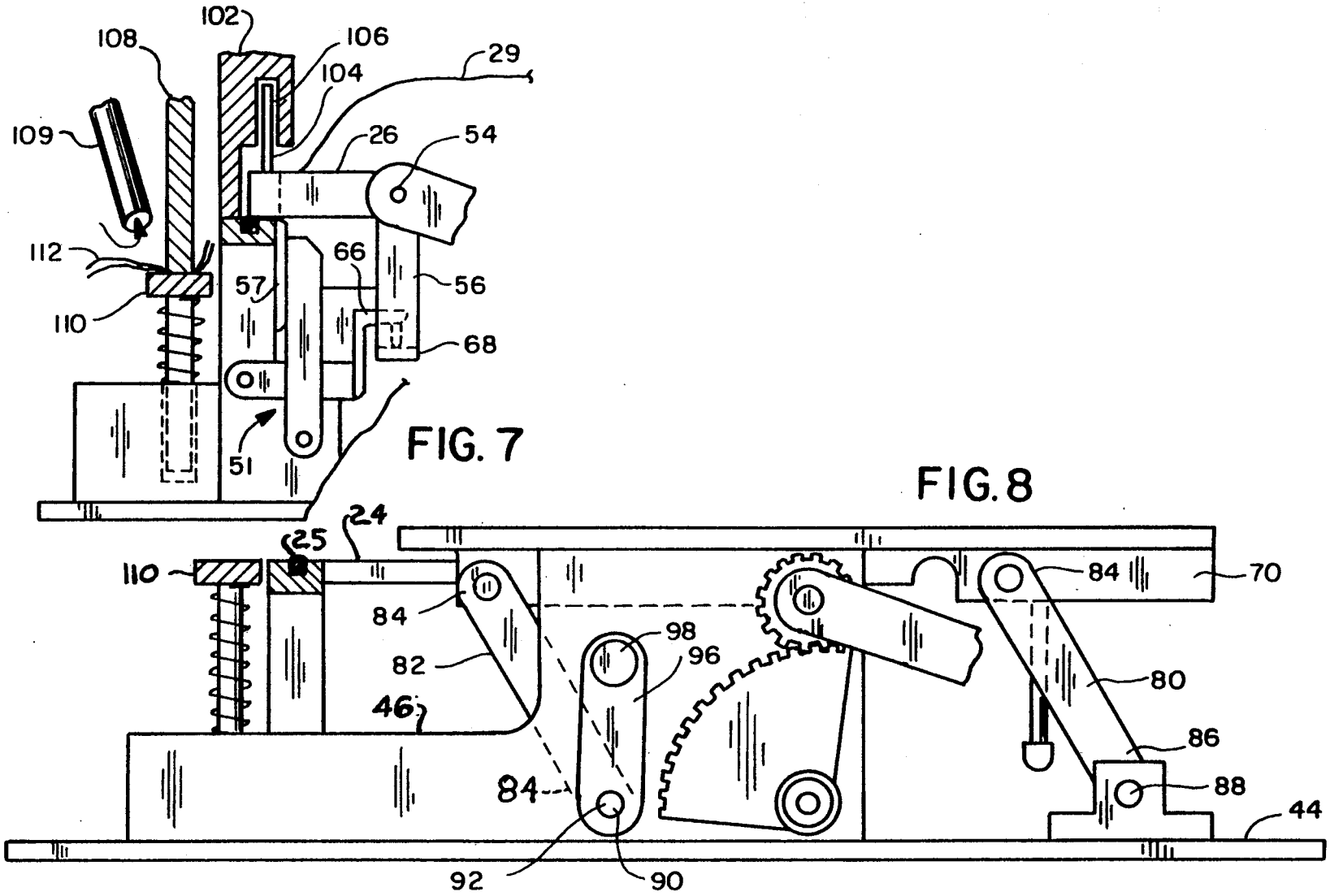
FIG. 8 is a view similar to FIG. 2 only showing the position of selected components in a bag unloading position.

The means for raising and lowering the platen comprises a parallel motion linkage formed by the two pairs of links 80, 82 (FIGS. 2, 3, and 8). The pairs of links are each pivoted at one end 84 to the spine 70 and at the other end 86 they are fixed to shafts 88, 90. Shafts 88, 90 are each journaled to the base 44 so that the spine is maintained in a generally horizontal position as it is raised and lowered. The outboard end 92 of shaft 90 extends through the outboard wall 46*b*. Fixed to this outboard end of the shaft end is one end of a lever arm 96. The other end of the lever arm carries a cam follower 98. Accordingly, rotation of lever arm 96 in a clockwise direction as viewed in the figures will raise the spine and platen sections whereas rotation in a counterclockwise direction will lower them.

The operation will be described beginning with reference to FIGS. 1–3. These figures show the position of components carried by the carriers 12 as each carrier enters the loading zone 14. In the loading zone platen 22 is in a lowered position and the platen sections 72, 74 form a V-shaped cradle. The clamp member 26 is at the limit of its clockwise movement so that it leads in the direction of carousel movement. In the loading zone, as shown in FIG. 1, an open heat sealable bag 29 containing an article to be vacuum packaged is moved from the table 28 and on to the platen 22. Preferably the article within the bag is butted against the anvil 24 and the bag neck 30 is pulled across the anvil so the length of the bag material between the product and the seal is minimized. Also, the bag neck 30 is arranged so it drapes across the anvil as shown in phantom in FIG. 2 and is stretched to its flat width. This eliminates, as much as possible, any wrinkles in the portion of the bag disposed across the anvil which will be heat sealed. As noted hereinabove, the height of the spine 70 and platen sections 72, 74 may be adjusted so the heat seal, when made, is located above or below center, and preferably on center, relative to the article within the bag.

The carrier then is index from the loading zone 14 to an idle position and then to the evacuating zone 16. In the course of this transit the cam follower 62 at the inboard side of the carrier engages fixed cam 32 so that spur gear 60 is rotated clockwise approximately 60° as viewed in the figures. The pinion 58 meshed with spur gear is rotated counterclockwise approximately 180° which swings both arms 52 and clamp member 26 in a counterclockwise direction over the bagged article 29 until the spring biased plunger 64 butts against stop 65 (FIG. 5). This holds the clamp member 26 slightly spaced from the O-ring 25 on anvil 24. In this position the bag neck 30 is not clamped firmly to the O-ring so that air can be evacuated from the bag.

At the evacuating zone 16, vacuum chamber 36 is lowered by arm 34 about the carrier until it seats against the base 44 of the carrier thereby effecting an air tight seal. After seating against the base 44, the vacuum chamber is communicated with a vacuum source (not shown) to evacuate air from within the chamber and the bag.

Extending through the wall of the vacuum chamber is a pair of solenoids 94. When evacuation has reached a desired level, or after a timed interval, both solenoids are operated. The operation of the solenoid extends a plunger 95 from the position shown in FIG. 5 to the position shown in FIG. 6. This extension causes the plunger to strike a plate 57 on the latch mechanism 51. This forces the latch mechanism to an over center position so the finger 66 engages and locks against shoulder 68. As described hereinabove, this draws the clamp member 26 down tightly against the O-ring 25. This compresses the O-ring and allows the latch mechanism 51 to go over its center to the locked position. In this locked position, clamp 26 is held tightly against the O-ring thereby effecting an air tight seal of the bag neck 30 disposed across the anvil.

The carousel next indexes the carrier to the heat sealing zone 18 and particularly to a position which locates the anvil end of the carrier beneath bridge 38 (FIG. 1). The bridge carries a heat sealer, a portion of which is shown at 102 in FIG. 7. The heat sealer, preferably of the electric impulse type, is lowered against the anvil surface to effect a heat sealing of the bag neck extending out from under the clamp member 26. To insure proper registration of the heat sealer relative to clamp 26, the clamp is provided with at least two guide pins 104 that upstand from the clamp when the clamp is in its closed position. As shown in FIG. 7, these pins are received into pilot openings 106 at the leading edge of the heat sealer as the heat sealer is lowered against the anvil. The heat sealer has some lateral play so the entry of the guide pins 104 into the pilot holes 106 serves to position the heat sealer relative to the clamp for making a seal close to the clamp.

While not shown in detail, it should be appreciated that the heat sealer applies two parallel seals. One heat seal closes the bag and the other allows for trimming the excess portion of the bag neck remaining after heat sealing. In this respect, the bag neck also drapes across a spring biased stripper plate 110 which upstands from the carrier base 44 just forward of anvil 24. After the heat sealer closes against the anvil any suitable drive means (not shown) such as a solenoid, is operated to move a trimmer bar 108 against the stripper plate 110. This pinches a portion of the bag neck between the two. As the trimmer continues to move downwardly, it depresses the spring biased stripper plate (FIG. 7) and this causes the excess portion of the bag neck to tear off from the second heat seal when the seal is hot. When the trimmer bar 108 is raised, the torn off bag scrap 112 is released and can be removed, either blown away by an air jet or sucked into a vacuum hose 109 attached to the heat sealer.

When the heat sealing operation is complete, the carousel indexes the carrier to the unloading station 22. In transit from the heat sealing zone to the unloading zone, the carrier transverses inboard and outboard cams 39 (FIG. 1). These cams engage and open both latch mechanisms 51 by moving each back over center to the position shown in FIG. 5. This releases clamp member 26. Next cam follower 62 on the inboard spur gear 60(*a*) traverses cam 40 which rotates the spur gear counterclockwise as viewed in the figures. This in turn rotates pinion 58 to swing the clamp 26 clockwise over the bagged article and back to the position shown in FIG. 2.

At the unloading zone a solenoid (not shown) is operated to engage and move the lever arm 96 clockwise as viewed in FIGS. 2 and 8. This operates the parallel motion linkages 80, 82 so as to elevate the platen 22, i.e. spine 72 and platen sections 72, 74 from the position shown in solid line in FIG. 4 to the position shown in FIG. 8. As the platen sections lift from pillars 78, they swing down about the hinge connections to spine 70 and assume a flat configuration as shown in dotted line in FIG. 4. At the elevated position, the platen 22 is above the level of anvil 24 and the top of side walls 46 so that the bagged article can be pushed from the platen and onto platform 28.

As shown in FIG. 1, pushing the bagged article from the platen is accomplished by an air cylinder 114. When this air cylinder is activated, a pusher element 116 extends from the air cylinder to the dotted line position shown in FIG. 1 for pushing the bagged article onto a discharge portion of platform 28. The platen then is lowered by engaging the cam follower 98 of the elevating mechanism so as to pivot the lever arm 96 counterclockwise Thereafter the carousel indexes the carrier back to the load position.

In another method embodiment the operating sequence is altered slightly to open the latch mechanisms 51 either simultaneously with the lifting of the heat sealer 102 or immediately after the heat sealer lifts from the anvil 24. This can be accomplished by eliminating inboard and outboard cams 39 and instead, positioning a solenoid operated member (not shown) at the heat sealing station to kick-open the over center locks of the latch mechanisms. Opening the latch members at this point in the operating sequence causes the clamp 26 to lift from the anvil which releases the compressed seal member 25. Since the seal member 25 is beneath the bag neck portion draped across the anvil, releasing the compressed seal member 25 causes it to pop the heat sealed bag portion up from the anvil surface. The heat seal is still hot but is no longer restrained by the operation of the clamp member so the seal shrinks, thickens and becomes stronger.

Thereafter the clamp member 26 is swung to its full open position during transit of the carrier to the unloading zone as described hereinabove.

There is still a further alternative method for releasing the heat sealed bag portion from the anvil. In this respect the heat sealed portion of the bag may adhere to the anvil and resist removal by the pop-up action of seal member 25. Accordingly, after the latch mechanisms 51 are opened in the sealing zone so the clamp 26 lifts from against the anvil, platen 22 is elevated relative to base 44. As the platen elevates, it raises the article-containing bag 29 relative to the anvil and this will pull and strip the heat sealed bag portion from the anvil.

Having described the invention in detail, what is claimed as new is:

1. Vacuum packaging apparatus comprising at least one carrier movable in a closed path through successive loading, evacuation, heat sealing and unloading zones, each carrier comprising:

a) a platen for receiving an open bag containing an article to be packaged, said platen having opposite first and second ends;

b) an upstanding anvil adjacent said platen first end for receiving an open neck portion of said bag draped across said anvil;

c) a clamp having end portions journaled at either side of said platen such that said clamp spans said platen and is pivotable over said platen from and between a full open position wherein said clamp is disposed adjacent said platen second end and a full closed position wherein said clamp is disposed against said anvil;

d) drive means operable in an interval between said loading and evacuating zone for swinging said clamp from said full open position and towards said full closed position; and e) latch means operable in said evacuation zone for engaging and drawing said clamp tightly against said anvil to effect a mechanical air tight seal of the bag neck draped across said anvil.

2. Apparatus as in claim 1 wherein said platen is supported on a base and said clamp comprises:

a) a generally U-shaped member spanning said platen;

b) an arm at each side of said U-shaped member, each arm journaled at one end to said base and attached at an opposite end to said U-shaped member; and c) said drive means engaging said arm at the journal of said arm to said base.

3. Apparatus as in claim 2 wherein the attachment of each arm to said U-shaped member provides for limited pivotal movement of said U-shaped member relative to said arm.

4. Apparatus as in claim 1 wherein each carrier includes:

a) a base having spaced upright walls;

b) said platen being disposed between said walls; and c) said anvil upstanding from said base and extending generally transverse said walls and being supported generally at the elevation of the top of said walls.

5. Apparatus as in claim 4 wherein each of said clamp end portions is journaled to one of said walls and said clamp spans the space between said walls.

6. Apparatus as in claim 4 wherein said platen is supported on elevating means for vertically moving said platen relative to said base from and between a low position adjacent said base and a high position above the level of said walls.

7. Apparatus as in claim 6 including drive means at said unloading station operably engageable with said elevating means for vertically moving said platen to said high position and a pusher at said unloading station for moving a bagged article from said elevated platform and over said one of said walls to discharge said bagged article from said carrier.

8. Apparatus as in claim 4 wherein each clamp end portion is an arm, each arm at one end being connected to said clamp and at an opposite end being journaled to one of said walls and including cooperating members on at least one of said arms and its associated wall for holding said clamp short of its full closed position to permit the evacuation of air through the portion of said bag draped across said anvil.

9. Apparatus as in claim 8 wherein said cooperating members comprise:

a) a stop;

b) a spring biased member engageable against said stop just prior to said clamp reaching said full closed position and said spring biased member being compressed against said stop to permit the movement of said clamp to said full closed position upon operation of said latch means.

10. Apparatus as in claim 9 wherein said stop is on one of said walls and said spring biased plunger is carried by one of said arms journaled thereto.

11. Apparatus as in claim 2 including a latch member connected to and extending from each leg of said U-shaped member, said latch member being said engageable by said latch means for drawing said clamp tightly against said anvil.

12. Apparatus as in claim 11 wherein the centroid of said U-shaped member lies on an axis extending through the point of connection of each latch member to said U-shaped member.

13. Apparatus as in claim 1 wherein said platen is supported on a base and each carriage includes an elevating means for raising and lowering said platen relative to said base.

14. Apparatus as in claim 13 wherein said platen comprises:

a) two sections hinged together along a midline and defining an included angle therebetween; and b) means for changing said included angle as said platen is raised and lowered.

15. Apparatus as in claim 14 wherein said included angle is less than 180° when said platen is at a lowered position and is increased to about 180° when said platen is at an elevated position.

16. Apparatus as in claim 13 wherein said platen has a spine portion oriented along the midline of said carrier; a section hinged to said spine on either side of said midline; and said elevating means for raising and lowering said sections is a parallel motion linkage journaled at its ends to said base and spine.

17. Apparatus as in claim 13 including means at said unloading zone operable to engage and drive said elevating means for raising said platen to its highest elevation.

18. Apparatus as in claim 17 including means between said unloading and loading zones operably engageable with said elevating means for lowering said platen prior to the placement thereon of said bag containing an article to be packaged.

19. Vacuum packaging method comprising the steps of:

a) moving a carrier through successive loading, evacuating, heat sealing and unloading zones;

b) placing an open article-containing bag having a pre-closed end onto said carrier at said loading zone and arranging the open end of the bag to a flat width;

c) during transit between said loading and evacuating zones, swinging a clamp member, which spans the article-containing bag over substantially the full length of the bag from a full open position adjacent the pre-closed end of the bag and towards a position adjacent to but spaced from the open end of the bag;

d) evacuating air from the article-containing bag in the evacuation zone and thereafter drawing said clamp member down to a position tightly clamped against the open bag end for effecting an air tight mechanical seal of the bag;

e) moving said carrier to said heat sealing zone and in transit exposing said article-containing bag to atmospheric pressure while maintaining said air tight mechanical seal;

f) heat sealing across the flat width of said bag to effect a permanent air tight seal thereof and then moving said carrier to said unloading zone;

g) releasing said clamp member and swinging it back over the length of the article-containing bag to the clamp full open position; and h) removing the now sealed article-containing bag from the carrier at the unloading zone.

20. A method as in claim 19 wherein said carrier includes a base, spaced side walls upstanding from the base for supporting the clamp member, and a vertically moveable platen in the space between the walls defining a surface for receiving the article-containing bag, said method further comprising the steps of:

a) moving said platen to a low level for receiving an open article-containing bag at said loading zone;

b) elevating said platen to an elevation above the level said walls at said unloading zone; and c) pushing a sealed article-containing bag transversely from said elevated platen and over one of said walls to a stationary receiving platform.

21. A method as in claim 20 wherein said platen includes two hinged together portions defining an included angle therebetween of less than 180° and increasing said included angle when elevating said platen.

22. A method as in claim 21 comprising increasing said included angle to substantially 180° when elevating said platen.

23. A method as in claim 19 comprising the steps of:

a) interposing bias means in the path of the clamp member to prevent it from reaching the tightly clamped position during said evacuating step and thereafter;

b) moving said clamp against the urging of said bias means to said tightly clamped position.

24. A method as in claim 19 wherein said clamp member is generally U-shaped and drawing said clamp member to a position tightly clamped against the open bag end comprises applying a force to the legs of said U-shape and directly said force through an axis which includes the centroid of said U-shaped member.

25. A method as in claim 19 including releasing said clamp member in said heat sealing zone.

26. A method as in claim 19 including swinging said clamp member back over the length of a sealed article-containing bag during transit of said carrier from said heat sealing zone to said unloading zone.

27. A method as in claim 19 wherein said carrier has a surface against which said heat sealing occurs and said heat sealing produces a heat sealed bag portion, further comprising releasing said heat sealed bag portion from said surface in said heat sealing zone.

28. A method as in claim 27 wherein releasing said heat sealed bag portion is accomplished by:

a) releasing said clamp member in said heat sealing zone; and b) moving the now heat sealed article containing bag relative to said surface.

29. A method as in claim 28 comprising elevating said now heat sealed article containing bag relative to said carrier to pull and strip the heat sealed portion from said surface.

* * * * *